US011311133B2

(12) United States Patent
Hale

(10) Patent No.: US 11,311,133 B2
(45) Date of Patent: Apr. 26, 2022

(54) SELECTIVELY SIZED ARTIFICIAL TREE AND WHEEL ASSEMBLY

(71) Applicant: William Hale, Cumming, GA (US)

(72) Inventor: William Hale, Cumming, GA (US)

(73) Assignee: Wintergreen Corporation, Alpharetta, GA (US)

( * ) Notice: Subject to any disclaimer, the term of this patent is extended or adjusted under 35 U.S.C. 154(b) by 557 days.

(21) Appl. No.: 16/032,103

(22) Filed: Jul. 11, 2018

(65) Prior Publication Data

US 2019/0014938 A1 Jan. 17, 2019

Related U.S. Application Data

(60) Provisional application No. 62/532,121, filed on Jul. 13, 2017.

(51) Int. Cl.
*A47G 33/06* (2006.01)
*A41G 1/00* (2006.01)

(52) U.S. Cl.
CPC ..... *A47G 33/06* (2013.01); *A41G 1/007* (2013.01)

(58) Field of Classification Search
CPC ..... A47G 33/06; A47G 33/04; A47G 1/007
See application file for complete search history.

(56) References Cited

U.S. PATENT DOCUMENTS 3,634,180 A * 1/1972 DeCosmo ..... A41G 1/00 428/20
5,971,172 A * 10/1999 Cockerham ..... A47G 33/06 211/181.1
2008/0107840 A1* 5/2008 Leung ..... A41G 1/007 428/20
2010/0284189 A1* 11/2010 Siu ..... A41G 1/007 362/249.19
2012/0024329 A1* 2/2012 Ma ..... B62B 3/02 135/16

FOREIGN PATENT DOCUMENTS

CN 106510421 A 3/2017
DE 202011106524 U1 2/2012
DE 202016001109 U1 3/2016

OTHER PUBLICATIONS

Wintergreen Corporation "Olympia Pine Tower Tree—Outdoor Commercial Christmas Tree", 2017, https://www.youtube.com/watch?v=fm3LvYSLzJY (Year: 2017).*
"Olympia Pine Tower Tree Video" document of screenshots and quotes from "Olympia Pine Tower Tree—Outdoor Commercial Christmas Tree" video (2017), compiled by Examiner (Year: 2017).*

* cited by examiner

*Primary Examiner* — Mark Ruthkosky
*Assistant Examiner* — Julia L Rummel
(74) *Attorney, Agent, or Firm* — FisherBroyles, LLP; Rachel H. Huffstetler

(57) ABSTRACT

A selectively sized artificial tree comprising a frame assembly including an upper frame and body frame. The artificial tree may be configured for trees of different heights, having different radii, and having different sector sizes such as full circle, semicircle for positioning against a wall, and conical for positioning in a corner. The frames which are less than full circle may be combined, such as two semi circles for forming a full tree. A wheel assembly is provided for moving the tree. The wheels are housed with the frame when not engaged.

22 Claims, 7 Drawing Sheets

SELECTIVELY SIZED ARTIFICIAL TREE AND WHEEL ASSEMBLY

CROSS REFERENCE TO RELATED APPLICATIONS

This application claims the benefit of Provisional Patent Application No. 62/532,121, filed Jul. 13, 2017, the disclosure of which is hereby incorporated by reference.

FIELD OF THE INVENTION

The present invention is directed to a selectively sized artificial tree frame and tree which may be displayed as a full round tree, as a half semi-circular or other sized tree (such as a quarter conical section), so as to selectively fit flush against a wall, in a corner of a room or away from the wall. Additionally, the present invention is directed to a novel wheel assembly for transporting the artificial tree.

BACKGROUND OF THE INVENTION

Artificial trees, such as Christmas trees, are often preferred to real trees because of their durability and the ability to be reused. This is particularly beneficial in commercial settings where numerous trees are displayed for commercial installations.

Artificial trees are well-known. Artificial trees which are "halved", that is, flat on the rear side and circular on the front face to define a semicircle shape which is flush against a wall, are also known. Corner trees, or trees that are a quarter of a circle, are also known to be positioned within a corner of a room or other structure. Prior art artificial trees do not, however, provide for selectively sized artificial trees, that is, a tree that may be displayed whole (full circle), half (semi-circle), quartered (quadrant shaped), or another circular sector. Conventional, large, full circle artificial trees are formed on stacked frame members. Very large trees, having a large circumference base, may include a frame member which is cut in two or more arcuate parts. These arcuate parts, however, do not have the stability to be self-standing, such as for use in a half or quarter sized tree.

It is advantageous to provide easy means for moving artificial trees as well, either for display in a different location or for transport to and from storage. Artificial tree stands are known to have wheels, but conventional wheels are not retracted within the tree frame when disengaged. Prior art wheels include a brake on the wheel to secure the tree in a desired location rather than moving the wheel into an inoperative position.

SUMMARY OF THE INVENTION

It is, therefore, advantageous for an artificial tree to have selective sizes. This is achieved by the present invention which provides for a novel frame assembly including an upper pole frame and a body frame. A pole connecting assembly and body connecting assembly provide means for securing adjacent frame members together.

It is also advantageous to for an artificial tree to have wheels with a braking assembly for easy, one-foot operation. It is advantageous to provide a rolling chassis for moving the tree, particularly once it is assembled. It is also advantageous to provide a rolling chassis which may be obscured from sight. This is achieved by the present invention which provides a novel wheel assembly which may be operated by the user's foot to engage and disengage the brake of the wheels, while the user's hands are free to support the tree. This and other objectives are met by the present invention.

DETAILED DESCRIPTION OF THE INVENTION

The present invention will now be described in detail hereinafter by reference to the accompanying drawings. The invention is not intended to be limited to the embodiments described; rather, this detailed description is provided to enable any person skilled in the art to make and practice the invention.

Figure 1A:
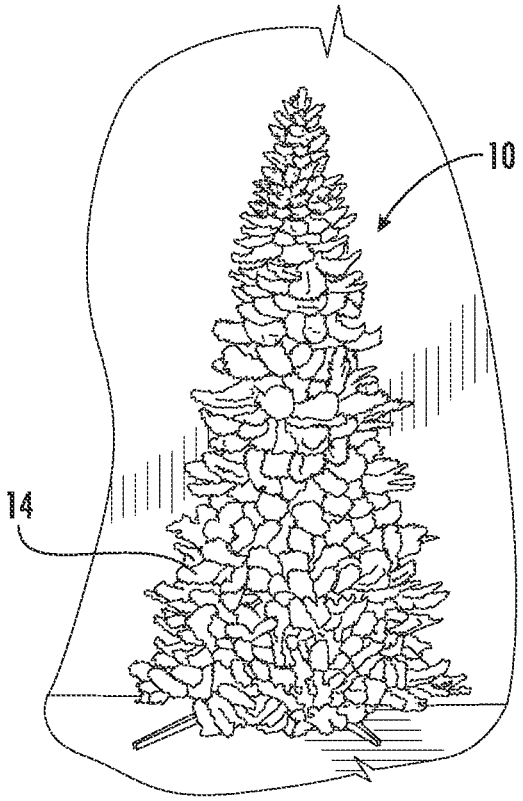
FIGS. 1A and 1B are perspective views of the selectively sized artificial tree according to the present invention in two different semi-conical configurations, that is, half and quarter conical sections, for positioning flush against a wall or in a corner, respectively.
Figure 1B:
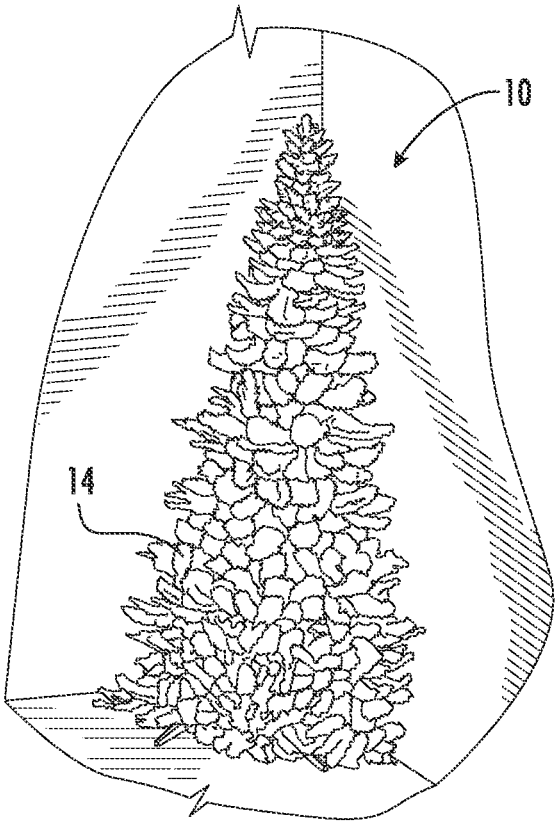
Figure 2:
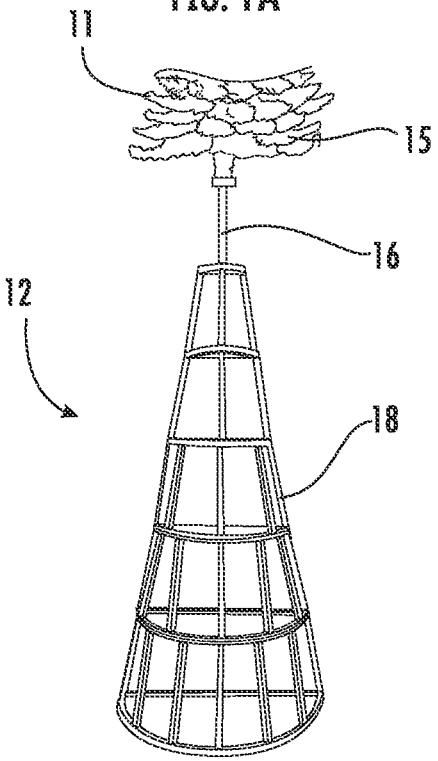
FIG. 2 is a front perspective view of the frame of the artificial tree of FIG. 1A.
Figure 3:
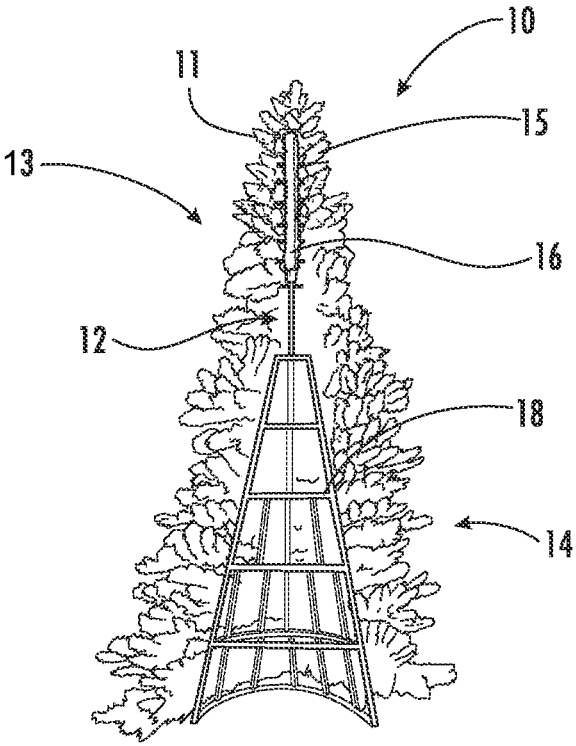
FIG. 3 is a rear perspective view of the artificial tree of FIG. 1A.
Figure 4:
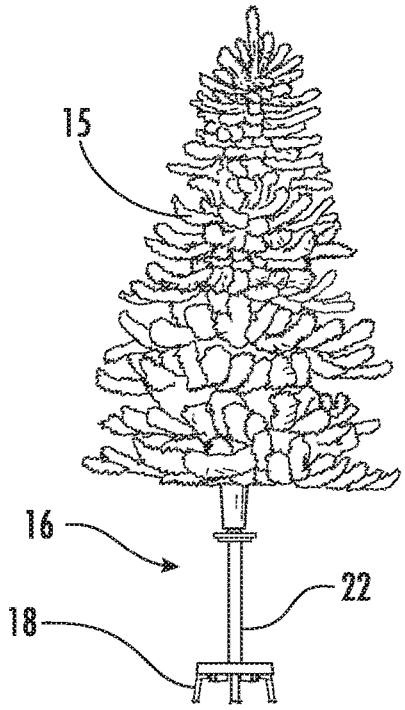
FIG. 4 is a front perspective view of the upper tree assembly and the upper frame assembly of the artificial tree frame of FIG. 1A.
Figure 5:
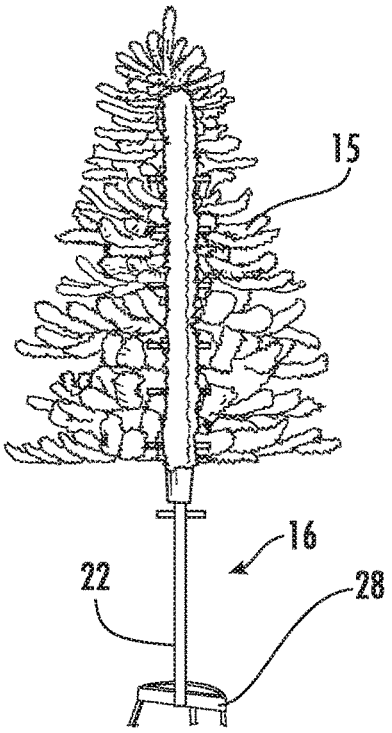
FIG. 5 is a rear perspective view thereof.

The artificial tree 10 includes a frame assembly 12 for supporting artificial branches 11 thereon. The description which follows refers to a half circle frame for resting flush against a flat wall. This is provided for the sake of discussion only and the discussion which follows applied to any conical section of a tree and/or tree frame. The frame assembly 12 as shown in FIGS. 1-5 comprises an upper tree assembly 13 having a tree top 15 and an upper frame 16 and a lower tree assembly 14 including a body frame 18. The tree top 15 is optionally provided and is a relatively short and easy to store conical section forming the tree top. The tree top 15 is preferably pre-assembled and includes branches which are not removeable. Of course, the artificial tree may be provided with removable branches which extend longitudinally to the top of the frame assembly 12 wherein the upper frame 16 defines the tree top. As shown in FIG. 2, the treetop 15 affixes to an upper portion of the upper frame 16.

The upper frame 16 of the upper tree assembly 13 shown in FIGS. 2-10 comprises at least one longitudinally extending pole 22 having a proximal end which is configured to mate with the treetop 15 and distal end configured to mate with the body frame 18 of the lower tree assembly 14. As shown in FIGS. 6A and 6B, the pole 22 includes at least one upper branch retainer 20 and, depending upon the height of the tree 10, a plurality of upper branch retainers 20. For a full circular tree 10, the upper branch retainer 20 may extend circumferentially around the pole 22 or may comprise a plurality of retainers 20 spaced circumferentially around the pole 22. For a less than full circular tree, the retainer 20 is arcuate (as shown if FIG. 6B) and extends the desired arc for the particular frame, such as for a half or quarter sized tree 10. Likewise, with a full circular tree 10, the retainer 20 may be formed of spaced apart retainers 20 rather than extending arcuately as a single retainer. The branch retainer 20 is defined by an arcuate frame 24 having at least one, and as shown, three or more radially extending clips 25 configured for receipt of branches. As shown, the clips 25 are preferably v-shaped for receiving a branch end having a hook-like end for mating with the clip 25 and frame 24. The length of the clips 25 may vary depending upon the size of the branch, the position of the branch retainer on the frame 16, and overall size of the tree 10 and branch.

Figure 7:
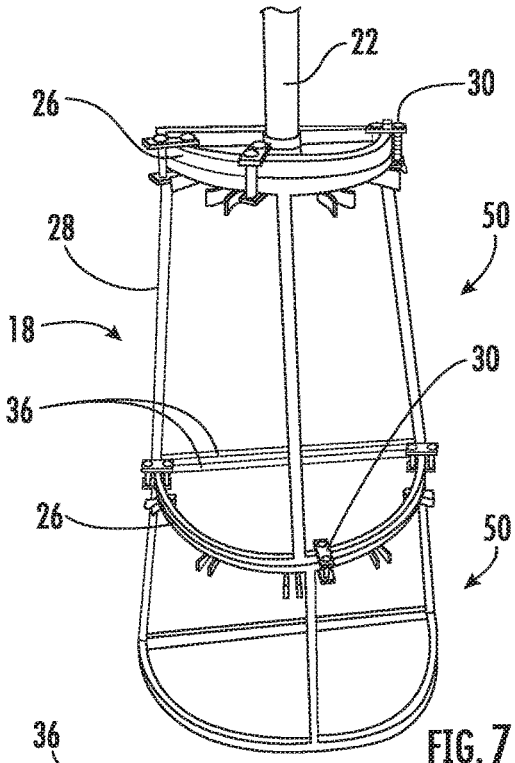
FIGS. 7-10 are a perspective views of variously sized frame members of the body frame assembly.
Figure 8:
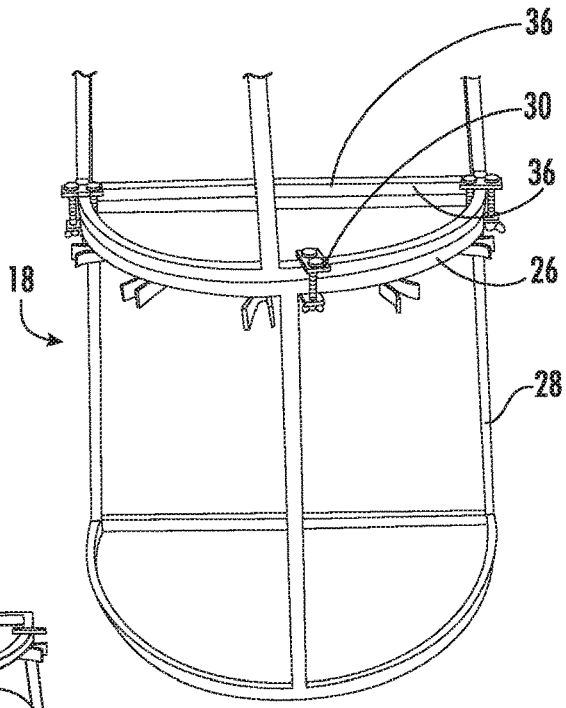
Figure 9:
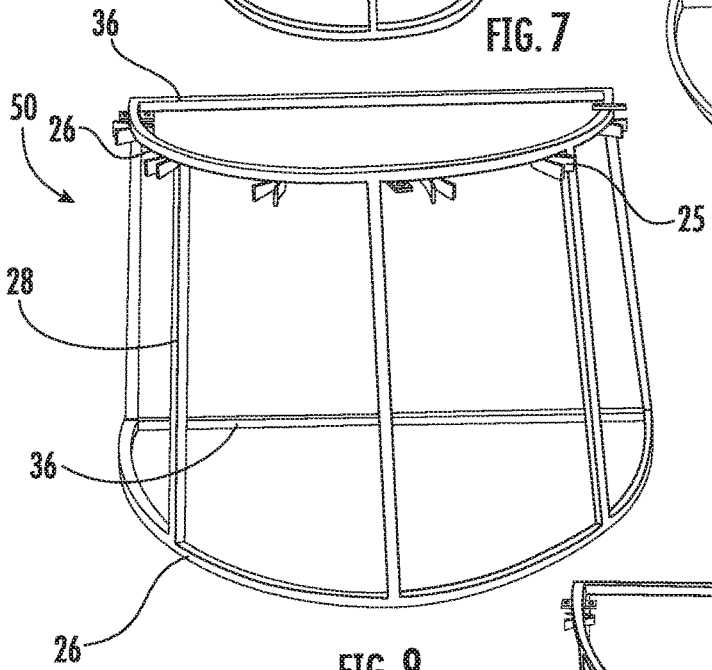
Figure 10:
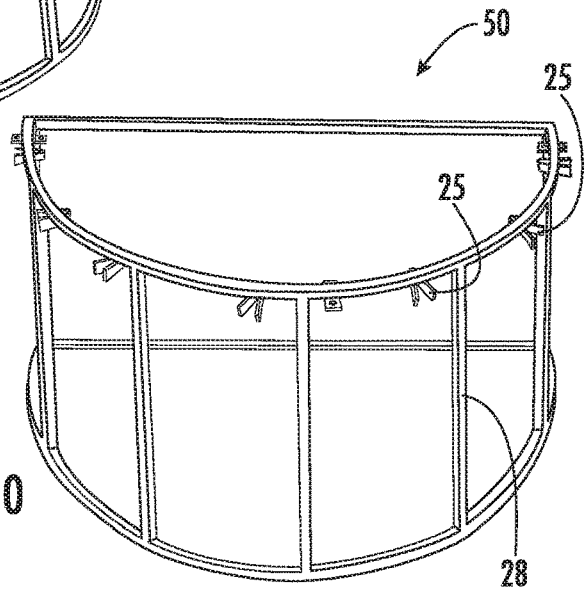

The lower body frame 18 comprises at least one, and as shown, a plurality of arcuate semicircular body members 50 comprising upper and lower ribs 26 and, if desired, longitudinal supports 28 extending substantially perpendicular to the ribs 26 and extending between the upper and lower rib 26. As shown in FIGS. 7-10, the radii of the body members forming the body frame 18 varies depending upon the overall size of the tree 10 and space constraints. The body members 50 are stacked in decreasing radius order with the largest body member positioned on the bottom to achieve the generally conical configuration. At least one or more brackets 30 connects adjacent body members of the body frame 18 as shown in FIGS. 7 and 8.

Importantly, the body members 50 include at least one and preferably, two horizontal braces 36 along the rear sides thereof. As shown in FIGS. 7-10, the braces 36 extend horizontally across the flat side of the body members along its upper and lower end. For other configurations less than 180 degrees, such as quartered trees, the braces include two horizontal braces 36 which define a 90-degree angle therebetween to conform to a corner, for example.

At least one, and as shown, a plurality of branch brackets or supports 25 are provided and radially displaced along the upper rib 26 of each body member of the body frame 12. The number and location of the branch supports 25 may vary depending upon the size of the tree, space constraints, and branch configuration. The retainers 25 are configured for receipt of an artificial tree branch which is inserted therein.

The description provided above pertains to the semicircle or half tree 10 as shown in the Figures. Other configurations of various sector sizes are within the scope of the present invention. For instance, any arcuate size less than 360 degrees, such as 90 degrees for corner placement, are envisioned.

As shown, a novel aspect of the present invention is that variously sized frame assemblies 12 having braces 36 may be combined to provide greater sector sized trees. For example, two semicircles to form a full circle, two conical (quarter sized) sectors to form a half, etc. Accordingly, the present invention provides means for joining more than one frame assembly 12. By way of example, FIGS. 12-18 depict two semicircle frame assemblies 12 being joined for forming a full circular tree 10.

Figure 11A:
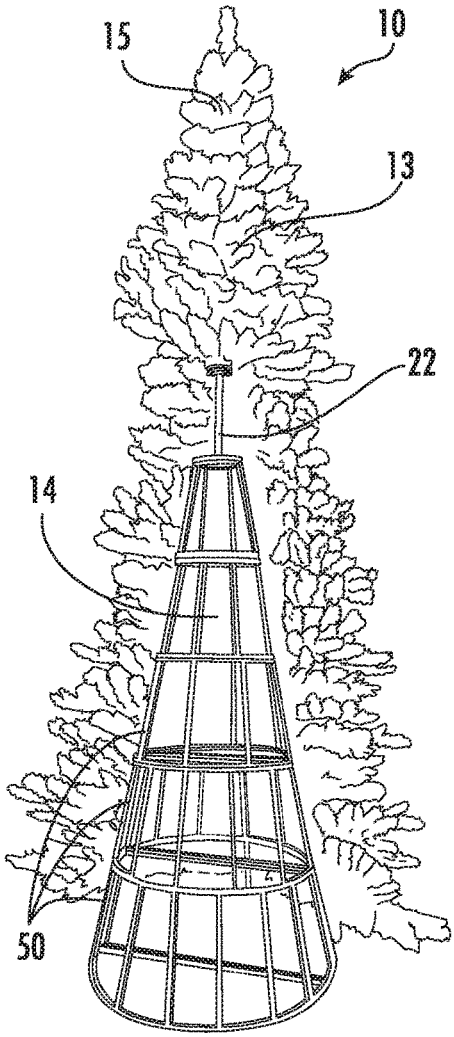
FIGS. 11A and 11B are perspective views of selectively sized artificial tree and frame according to the present invention in the full circular configuration.
Figure 11B:
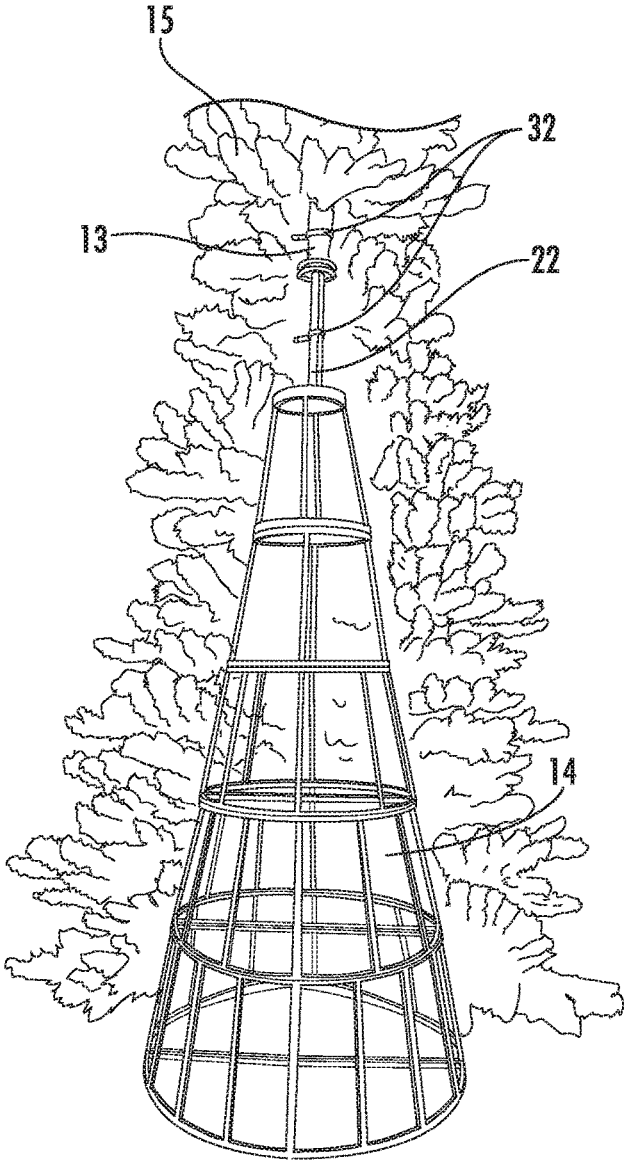
Figure 12:
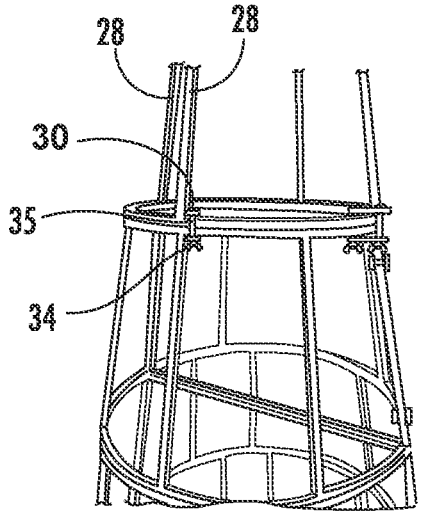
FIG. 12 a perspective view of the frame assembly according to the present invention.
Figure 13:
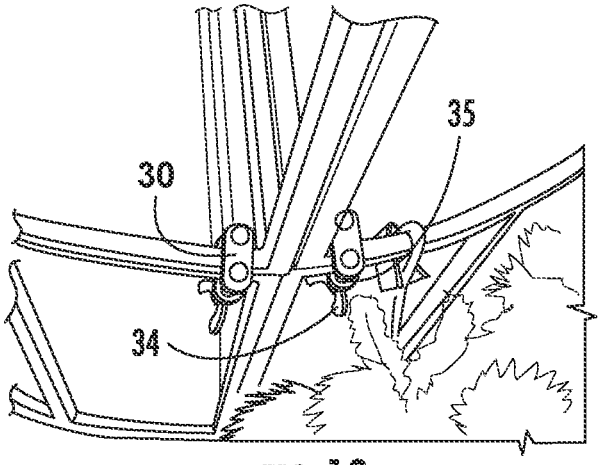
FIG. 13 is an enlarged view thereof.
Figure 14:
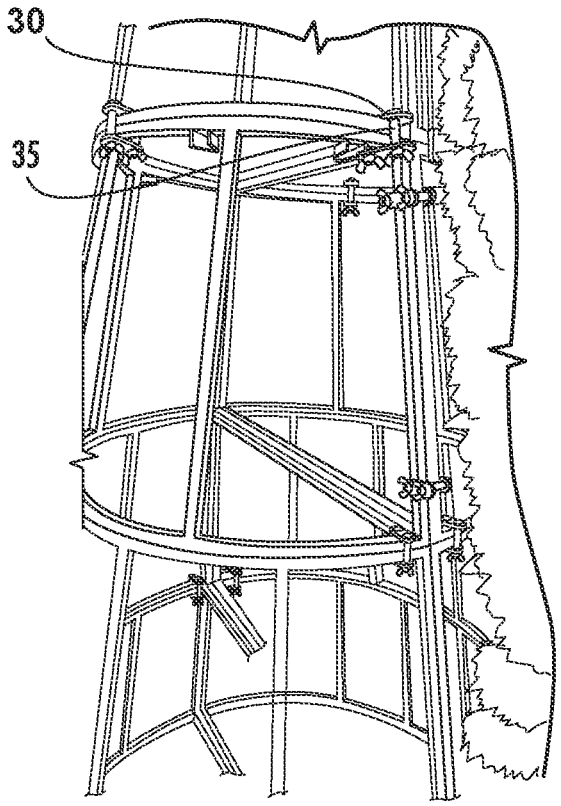
FIGS. 14 and 15 are perspective views thereof.
Figure 15:
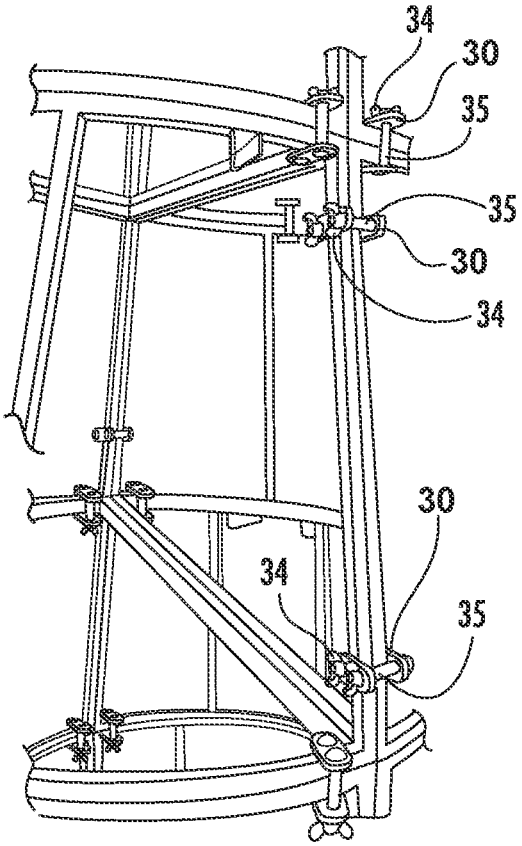
Figure 17:
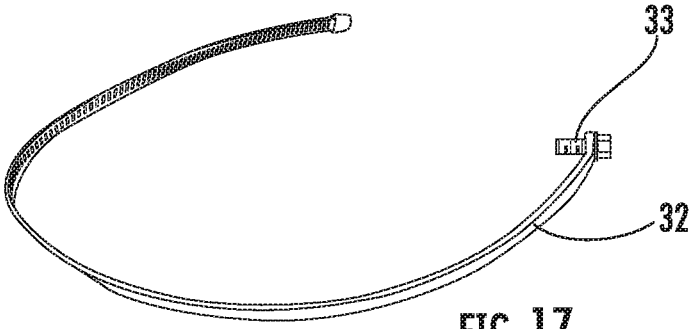
FIG. 17 is a perspective view of a connecting member.
Figure 16:
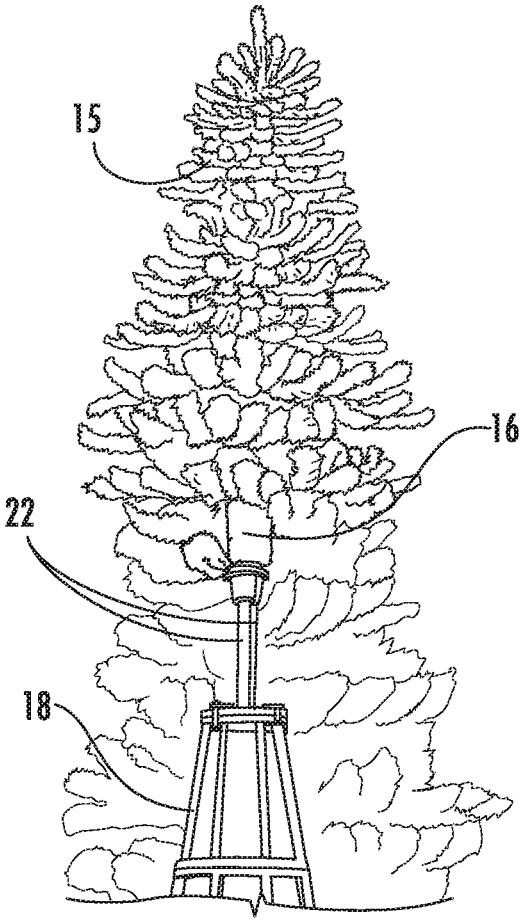
FIG. 16 is a perspective view of the upper frame assembly for a full circle configuration.
Figure 18:
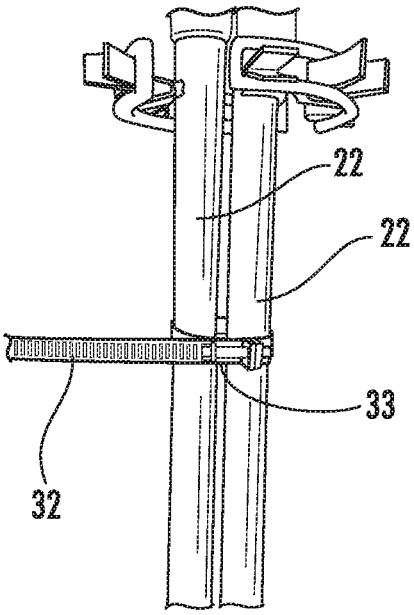
FIG. 18 is a view of the upper frame assembly connection.

As shown in FIGS. 16 and 17, two or more treetops 15 and two or more poles 22 of the upper frames 16 are optionally secured to one another to form the desired tree size. Of course, it is within the scope of the present invention to provide interchangeable treetops, for example, a full circle treetop which may replace two half treetops wherein no securing means is needed. When two half treetops are utilized to form a full circle tree, the half treetops (and poles) may be self-standing or, alternatively, may be secured to one another by optional securing means. As shown, the securing means comprises a banding strap 32 and a closure 33. As shown in the Figures, one banding strap 32 is provided to secure two treetops 15 as shown in FIG. 11B and a second banding strap 32 is provided to secure two poles 22. Of course, more than one may be provided for each or none may be needed to join the treetop 15, upper frame 16 and/or body frame 18.

Stacked body frame members 50 of the frame assembly 12 are joined to an adjacent vertical body frame 18 with securing means. The securing means of the body frame 18, as shown in FIGS. 12-15, comprises a bracket 30, bolts 34 and nuts 35. A pair of securing members, each comprising a bolt 34 and nut 35, are positioned along the length of the outer most longitudinal supports 28 defining the side edge of the respective frame member 50 of the body frame 18. Depending upon the overall size of the tree 10 and the support needed, the number of the securing means may vary. The nut and bolt 35, 34 thereby connect adjacent body frame members 50 vertically to form a tree which is the dimension of the combined sector portions. Securing members in the form of a bracket 30 also secures adjacent frame members 50 horizontally such as for combining to half frame assemblies 12 to form a circular frame assembly 12. A nut and bolt are used to secure the brackets 30.

Figure 6A:
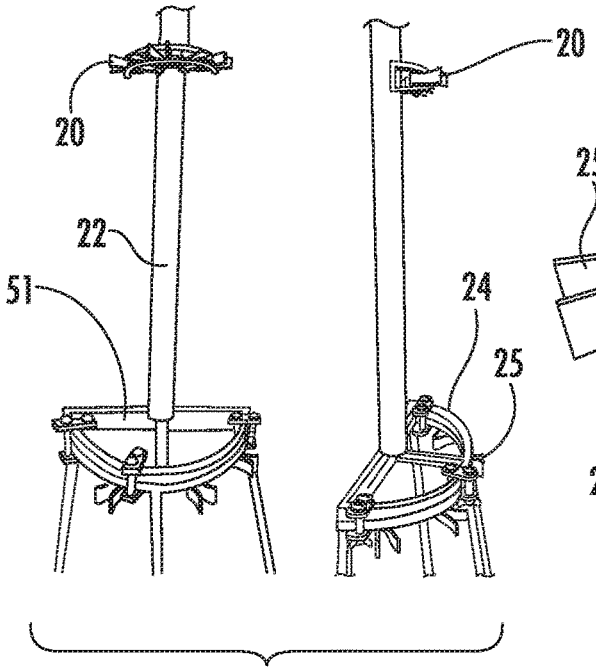
FIGS. 6A and 6B are perspective views of the upper frame assembly and an enlarged view thereof, respectively.
Figure 6B:
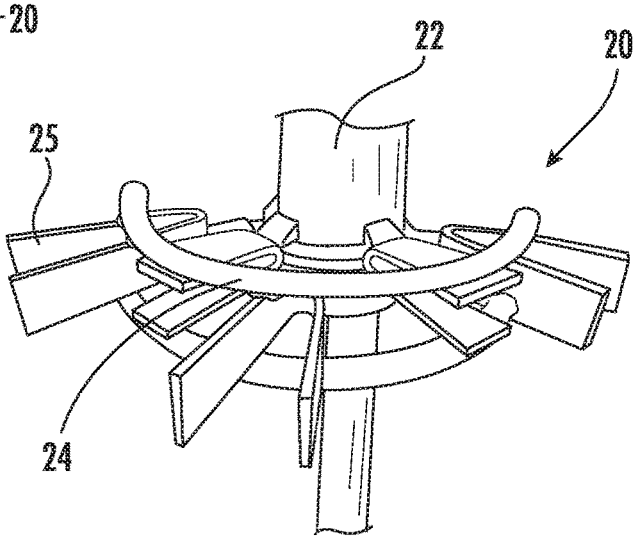

As best shown in FIG. 6A, the upper tree assembly 13 includes a support 51 connected to the distal end of the upper frame pole 20. The support 51 is configured to cooperate with the uppermost rib of the lower tree assembly 14 and securing means comprising a bracket 30, bolts 35 and nuts 34 are used to connect the upper frame 16 and the body frame 18.

Figure 19:
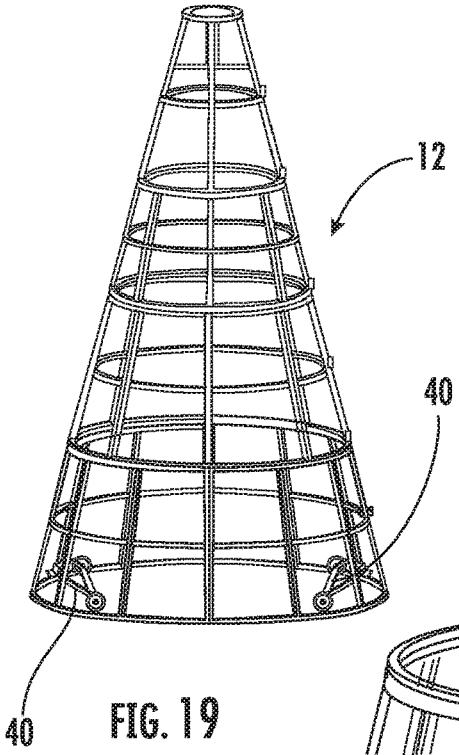
FIG. 19 is a perspective view of the frame assembly with the wheel assembly.
Figure 20:
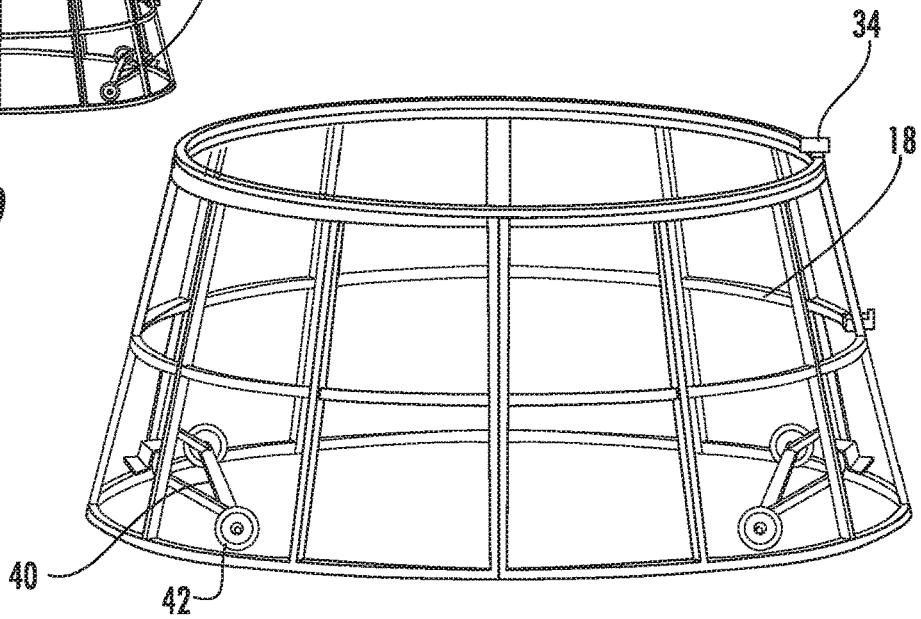
FIG. 20 is a perspective view of a body frame member with the wheel assembly.
Figure 21:
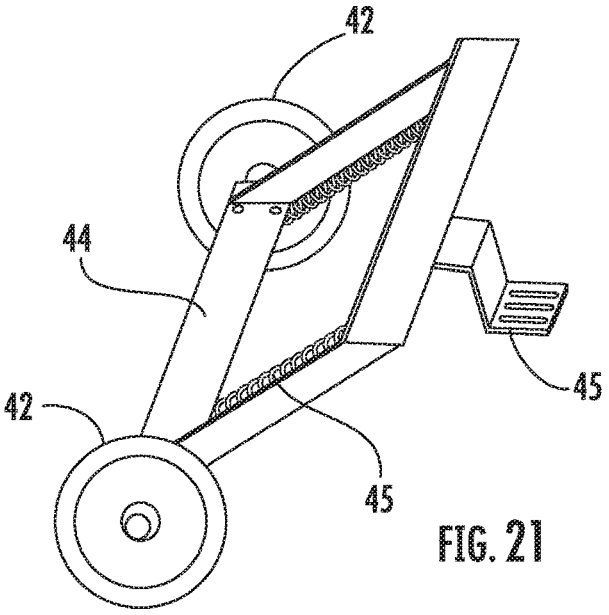
FIG. 21 is a perspective view of the wheel assembly.

As shown in FIGS. 1-18, the frame assembly 12 rests on the floor to support the tree 10. It is advantageous to provide a rolling chassis 40 for moving the tree 10, particularly once it is assembled. It is also advantageous to provide a rolling chassis 40 which may be obscured from sight. FIGS. 19-21 show the rolling chassis 40 according the present invention. These Figures illustrate a full circular tree 10, but it is understood that the chassis 40 may be applied to a frame assembly 12 of any configuration, for example, semicircle (flush against wall) or quarter sector configuration (flush against a corner) without departing from the scope of the invention. The number of chassis 40 provided and positions thereof on the frame assembly 12 may be varied.

As shown, two rolling chassis 40 are provided and are positioned on radially opposing side surfaces of the lower rib 26 of the bottom most body member of the body frame 18. This arrangement enables the tree to be rolled upright. If one rolling chassis 40 is provided, the tree 10 may be tilted towards the wheels and moved.

The rolling chassis 40 comprises at least one, and preferably two, wheels 42 supported on the chassis frame 44. At least one spring 45 is provided for each wheel 42 to bias the wheel into a raised position. A foot pedal 45 is used to actuate the frame 44 to raise and lower the wheels 44 to engage and disengage the ground 44. The foot pedal 45 may be engaged to lower the wheels 44 whereby the frame assembly 12 is raised and the wheels engage the ground without the drag of the frame assembly 12. Once the tree is positioned the petal is actuated by downward pressure, such as by a foot, and the wheels 44, under the bias of the springs 45, revert upward and the frame assembly 12 rests on the floor. The rolling chasses 40 is thereby housed within the frame assembly 12 and is not visible.

While exemplary embodiments have been shown and described above for the purpose of disclosure, modifications to the disclosed embodiments may occur to those skilled in the art. The disclosure, therefore, is not limited to the above precise embodiments and that changes may be made without departing from its spirit and scope.

What is claimed is:

1. An artificial tree assembly for selectively sized trees comprising:

at least one frame assembly comprising an upper frame assembly and at least one lower frame assembly connected to one another wherein said upper and said at least one lower frame assemblies are configured for receipt of tree branches;

said upper frame assembly comprising a longitudinally extending pole having a proximal and distal end, said proximal end configured to mate with a treetop and said distal end configured to mate with said at least one lower frame assembly, said upper frame assembly comprising at least one retainer positioned along the length of said central pole, said retainer being configured for receipt of a tree branch;

said at least one lower frame assembly comprising an arcuate first body member comprising longitudinal supports defining opposing longitudinally extending side edges, said first body member comprising an arcuate upper rib having a first radius and an arcuate lower rib having a second radius wherein said second radius is greater than said first radius and said arcuate upper and lower ribs extending between said longitudinally extending side edges, said first body member further comprising at least one horizontal brace extending between said longitudinally extending side edges and extending perpendicular to said longitudinally extending side edges so as to intersect at least one of the arcs defined by said first radius and said second radius wherein said at least one lower frame assembly supports the artificial tree assembly and wherein said at least one lower frame assembly is self-standing; and a securing member for connecting said upper frame assembly and said at least one lower frame assembly.

2. The artificial tree assembly according to claim 1 wherein said at least one lower body frame assembly comprises a second body member configured to be positioned above said first body member wherein said upper rib of said second body member has a third radius and said lower rib of said second body member has a fourth radius wherein said fourth radius is greater than said third radius and said fourth radius is no greater than said first member first radius of said first body member.

3. The artificial tree according to claim 2 further comprising a securing bracket for securing said first and second lower frame assembly body members.

4. The artificial tree according to claim 1 wherein said horizontal brace is non-linear and includes two braces which defines a right angle therebetween.

5. The artificial tree according to claim 1 wherein said horizontal brace is non-linear and includes two braces which defines an acute angle therebetween.

6. The artificial tree according to claim 1 further comprising two of said at least one horizontal braces, a first of said horizontal braces extending between opposing side edges of said upper ribs and a second of said horizontal braces extending between opposing side edges of said lower rib.

7. The artificial tree according to claim 1 wherein said retainer extends arcuately a predetermined distance around said pole.

8. The artificial tree according to claim 7 wherein said retainer extends circumferentially around said pole.

9. The artificial tree assembly according to claim 1 further comprising:

two of said at least one frame assembly; and at least one securing bracket for securing the lower frame assemblies of said two frame assemblies wherein the frame assemblies are connected to form a larger artificial tree.

10. The artificial tree assembly according to claim 9 further comprising at least four of said at least one frame assembly and at least four of said securing members.

11. The artificial tree according to claim 1 further comprising at least one rolling chassis connected to said at least one lower body frame member adjacent said lower rib wherein said rolling chassis comprises a chassis frame and at least one wheel wherein said at least one wheel is biased in a raised position and wherein said rolling chassis extends radially inwardly from said lower rib.

12. An artificial tree assembly for selectively sized trees comprising:

at least two frame assemblies, each comprising an upper frame assembly and at least one lower body frame assembly connected to one another wherein said upper and said at least one lower body frame assemblies are configured for receipt of tree branches;

said upper frame assembly of each of said two frame assemblies comprises a longitudinally extending pole having a proximal and distal end, said proximal end configured to mate with a treetop and said distal end configured to mate with said at least one lower body frame assembly of each of said at least two frame assemblies;

said at least one lower body frame assembly comprising a first body member comprising an arcuate upper rib having a first radius and an arcuate lower rib having a second radius wherein said second radius is greater than said first radius and at least one longitudinal support extending between said upper and lower ribs, said first body member further comprising at least one horizontal brace wherein said at least one lower frame assembly supports the artificial tree assembly and wherein said at least one lower frame assembly is self-standing; and wherein said at least two frame assemblies are positioned in a side-by-side position and said tree assembly further comprises a pole connecting assembly for connecting said proximal ends of said poles of each of said two frame assemblies.

13. The artificial tree assembly according to claim 12 wherein said at least one lower body frame assembly of each of said at least two frame assemblies comprises a second body member configured to be positioned above said first body member wherein said upper rib of said second body member has a third radius and said lower rib of said second body member has a fourth radius wherein said fourth radius is greater than said third radius and said fourth radius is no greater than said first member first radius of said first body member.

14. The artificial tree according to claim 13 wherein said at least one lower body frame comprises at least one support positioned along one of said upper and lower ribs, said support being configured for receipt of a tree branch.

15. The artificial tree according to claim 13 comprising a securing bracket for securing said first and second lower frame assembly body members.

16. The artificial tree according to claim 12 wherein said horizontal brace is non-linear and includes two braces which defines a right angle therebetween.

17. The artificial tree according to claim 12 wherein said horizontal brace is non-linear and includes two braces which defines an acute angle therebetween.

18. The artificial tree according to claim 12 further comprising at least one rolling chassis connected to said at least one lower body frame member adjacent said lower rib wherein said rolling chassis comprises a chassis frame and at least one wheel wherein said at least one wheel is biased in a raised position and wherein said rolling chassis extends radially inwardly from said lower rib.

19. The artificial tree according to claim 1 wherein said at least one horizontal brace extends across said lower rib of said arcuate first body member.

20. The artificial tree according to claim 19 wherein said at least one horizontal brace includes at least two of said horizontal braces including an upper and lower horizontal brace wherein said upper horizontal brace extends across said upper rib of said arcuate first body member and said lower horizontal brace extends across said lower rib.

21. The artificial tree according to claim 1 wherein said at least one horizontal brace extends across said upper rib of said arcuate first body member.

22. The artificial tree according to claim 12 wherein said securing member is a banding strap for securing said poles.

* * * * *